US005781837A

United States Patent [19]

Genovese

[11] Patent Number: 5,781,837

[45] Date of Patent: Jul. 14, 1998

[54] MAGNETIC FLEXIBLE BELT FOR NON-INTERACTIVE AGITATED MAGNETIC BRUSH DEVELOPMENT

[75] Inventor: Frank C. Genovese, Fairport, N.Y.

[73] Assignee: Xerox Corporation, Stamford, Conn.

[21] Appl. No.: 886,165

[22] Filed: Jun. 30, 1997

[51] Int. Cl.[6] ..... G03G 15/09

[52] U.S. Cl. ..... 399/278

[58] Field of Search ..... 399/277, 278, 399/267

[56] References Cited

U.S. PATENT DOCUMENTS

| | | | |
|---|---|---|---|
| 2,786,441 | 3/1957 | Young | 399/278 |
| 2,832,311 | 4/1958 | Byrne | 399/278 |
| 4,067,295 | 1/1978 | Parker et al. | 399/277 |
| 4,566,779 | 1/1986 | Coli et al. | 399/278 X |
| 5,040,004 | 8/1991 | Schmidlin et al. | 399/278 X |
| 5,246,099 | 9/1993 | Genovese | 198/807 |
| 5,409,791 | 4/1995 | Kaukeinen et al. | 430/54 |

*Primary Examiner*—S. Lee

*Attorney, Agent, or Firm*—Lloyd E. Bean, II

[57] ABSTRACT

A development system is which includes a flexible belt having a magnetic surface. The belt has a static magnetic field pattern for transporting developer material to a development zone; and a magnetic system for generating a superimposed alternating magnetic field to agitate developer material in the development zone in order to produce a charged toner cloud intended for the non-interactive development of latent electrostatic images.

8 Claims, 7 Drawing Sheets

MAGNETIC FLEXIBLE BELT FOR NON-INTERACTIVE AGITATED MAGNETIC BRUSH DEVELOPMENT

BACKGROUND OF THE PRESENT INVENTION

The invention relates generally to an electrophotographic printing machine and, more particularly, to a development system which includes a flexible belt having a magnetic surface or a developer roll with a magnetic sleeve, the belt or sleeve having a static magnetic field pattern for transporting developer material to a development zone; and a magnetic system for generating a superimposed alternating magnetic field to agitate developer material in the development zone in order to produce a charged toner cloud intended for the non-interactive development of latent electrostatic images.

INCORPORATED BY REFERENCE

The following are incorporated for there teachings U.S. appl. Ser. No. 08/886,166 entitled "MAGNETIC SLEEVE FOR NON-INTERACTIVE AGITATED MAGNETIC BRUSH DEVELOPMENT" and U.S. appl. Ser. No. 08,885, 910 entitled "APPARATUS AND METHOD FOR NON-INTERACTIVE AGITATED MAGNETIC BRUSH DEVELOPMENT" both application filed concurrently herewith.

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic latent image on the photoconductive member corresponding to the informational areas contained within the document. After the electrostatic latent image is formed on the photoconductive member, the image is developed by bringing a developer material into proximal contact therewith. Typically, the developer material comprises toner particles adhering triboelectrically to carrier granules. The toner particles are attracted to the latent image from the carrier granules and form a powder image on the photoconductive member which is subsequently transferred to a copy sheet Finally, the copy sheet is heated or otherwise processed to permanently affix the powder image thereto in the desired image-wise configuration.

In the prior art, both interactive and non-interactive development has been accomplished with magnetic brushes. In typical interactive embodiments, the magnetic brush is in the form of a rigid cylindrical sleeve which rotates around a fixed assembly of permanent magnets. In this type development system, the cylindrical sleeve is usually made of an electrically conductive, non-ferrous material such as aluminum or stainless steel, with its outer surface textured to improve developer adhesion. The rotation of the sleeve transports magnetically adhered developer through the development zone where there is direct contact between the developer brush and the imaged surface, and toner is stripped from the passing magnetic brush filaments by the electrostatic fields of the image.

Non-interactive development is most useful in color systems when a given color toner must be deposited on an electrostatic image without disturbing previously applied toner deposits of a different color or cross-contaminating the color toner supplies.

U.S. Pat. No. 5409791 to Kaukeinen et al. describes a non-interactive magnetic brush development method employing a rotating magnetic multipole core within a passive sleeve to provide a regular matrix of surface gradients that attract magnetic carrier to the sleeve. As the core rotates in one direction within the sleeve, the magnetic field lines rotate in the opposite sense at the surface of the sleeve, causing the brush filaments to follow suit. The collective tumbling action of the filaments transports bulk developer material along the sleeve surface. The mechanical agitation inherent in the rotating filaments dislodges toner particles from the carrier beads that form the brush filaments making them available for transport across a gap to the photoreceptor surface under the influence of the proximal development fields of the image. U.S. Pat. No. 5409791 assigned to Eastman Kodak Company is hereby incorporated by reference.

It has been observed that the magnetic brush height formed by the developer mass in the magnetic fields on the sleeve surface in this type development system is periodic in thickness and statistically noisy as a result of complex carrier bead agglomeration and filament exchange mechanisms that occur during operation. As a result, substantial clearance must be provided in the development gap to avoid photoreceptor interactions through direct physical contact, so that the use of a closely spaced developer bed critical to high fidelity image development is precluded.

The magnetic pole spacing cannot be reduced to an arbitrarily small size because allowance for the thickness of the sleeve and a reasonable mechanical clearance between the sleeve and the rotating magnetic core sets a minimum working range for the magnetic multipole forces required to both hold and tumble the developer blanket on the sleeve. Since the internal pole geometry defining the spatial wavelength of the tumbling component also governs the magnitude of the holding forces for the developer blanket at any given range, there is only one degree of design freedom available to satisfy the opposing system requirements of short spatial wavelength and strong holding force. Reducing the developer blanket mass by supply starvation has been found to result in a sparse brush structure without substantially reducing the brush filament lengths or improving the uneven length distribution.

SUMMARY OF THE INVENTION

The present invention obviates the problems noted above by utilizing a development system including a developer transport adapted for depositing developer material on an imaging surface having an electrostatic latent image thereon, said developer transport comprising: a core; a rotating drive means; a magnetic transport member rotating about said core, said magnetic transport member having a static magnetic field pattern for transporting developer material to a development zone; and means for generating a superimposed alternating magnetic field to agitate developer material in said development zone.

There is provided a magnetic transport member is in the form of a magnetic sleeve rotating around a core containing a magnetic source configured to agitate developer within a defined development zone.

There is provided a magnetic transport member is in the form of a flexible magnetic belt constrained to travel over the surface of a guide, with a magnetic source configured to agitate developer within a defined development zone

DESCRIPTION OF THE INVENTION

Figure 1:
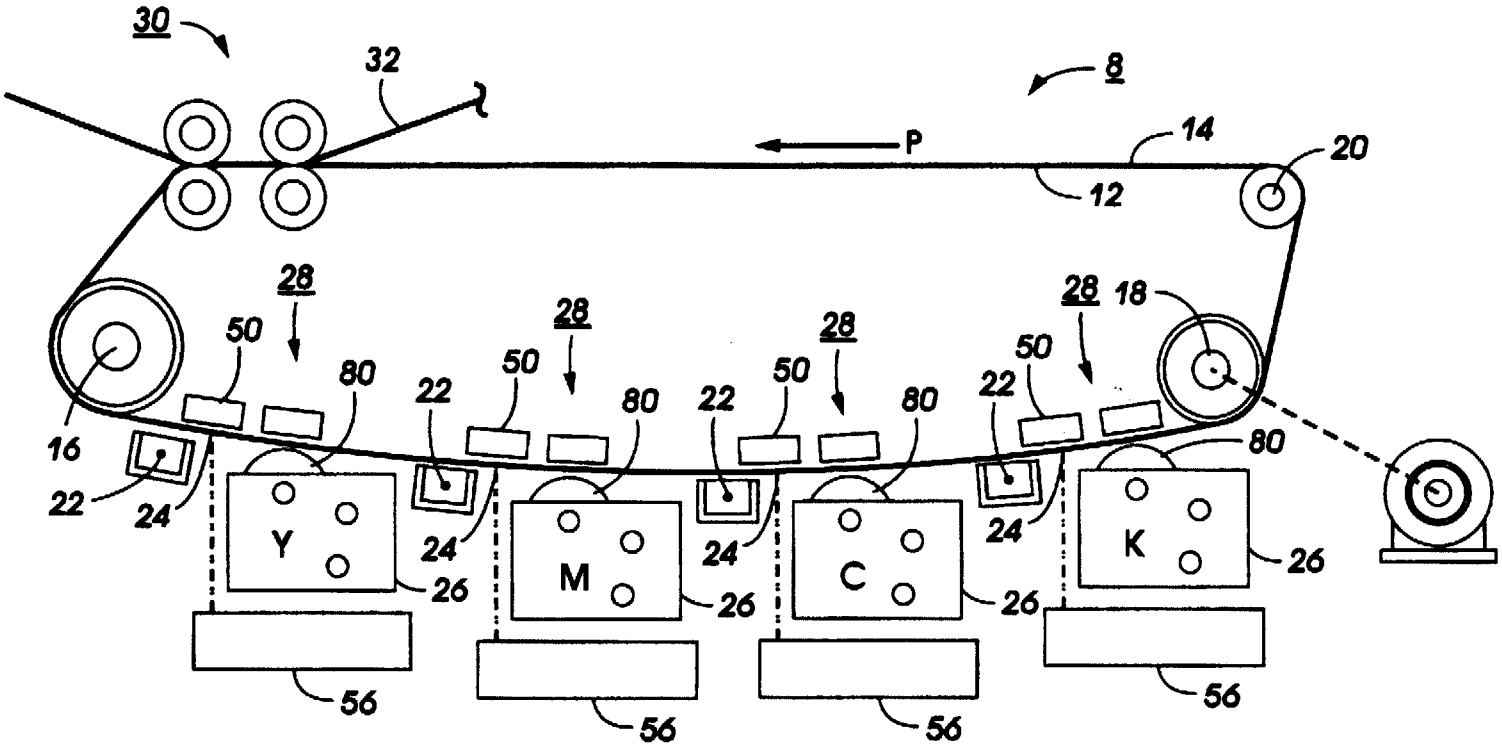
FIG. 1 is a side view, in section, of a four color xerographic reproduction machine incorporating the non-interactive magnetic brush developer of the present invention.

Referring to FIG. 1 of the drawings, there is shown a xerographic type reproduction machine 8 incorporating an embodiment of the non-interactive agitated magnetic brush of the present invention, designated generally by the numeral 80. Machine 8 has a suitable frame (not shown) on which the machine xerographic components are operatively supported. As will be familiar to those skilled in the art, the machine xerographic components include a recording member, shown here in the form of a rotatable photoreceptor 12. In the exemplary arrangement shown, photoreceptor 12 comprises a belt having a photoconductive surface 14. The belt is driven by means of a motorized linkage along a path defined by rollers 16, 18 and 20, and those of transfer assembly 30, the direction of movement being counterclockwise as viewed in FIG. 1 and indicated by the arrow marked P. Operatively disposed about the periphery of photoreceptor 12 are charge corotrons 22 for placing a uniform charge on the photoconductive surface 14 of photoreceptor 12; exposure stations 24 where the uniformly charged photoconductive surface 14 constrained by positioning shoes 50 is exposed in patterns representing the various color separations of the document being generated; development stations 28 where the latent electrostatic image created on photoconductive surface 14 is developed by toners of the appropriate color; and transfer and detack corotrons (not shown) for assisting transfer of the developed image to a suitable copy substrate material such as a copy sheet 32 brought forward in timed relation with the developed image on photoconductive surface 14 at image transfer station 30. In preparation for the next imaging cycle, unwanted residual toner is removed from the belt surface at a cleaning station (not shown).

Following transfer, the sheet 32 is carried forward to a fusing station (not shown) where the toner image is fixed by pressure or thermal fusing methods familiar to those practicing the electrophotographic art. After fusing, the copy sheet 32 is discharged to an output tray.

At each exposure station 24, photoreceptor 12 is guided over a positioning shoe 50 so that the photoconductive surface 14 is constrained to coincide with the plane of optimum exposure. A laser diode raster output scanner (ROS) 56 generates a closely spaced raster of scan lines on photoconductive surface 14 as photoreceptor 12 advances at a constant velocity over shoe 50. A ROS includes a laser source controlled by a data source, a rotating polygon mirror, and optical elements associated therewith. At each exposure station 24, a ROS 56 exposes the charged photoconductive surface 14 point by point to generate the latent electrostatic image associated with the color separation to be generated. It will be understood by those familiar with the art that alternative exposure systems for generating the latent electrostatic images, such as print bars based on liquid crystal light valves and light emitting diodes (LEDs), and other equivalent optical arrangements could be used in place of the ROS systems such that the charged surface may be imagewise discharged to form a latent image of the appropriate color separation at each exposure station.

Developer assembly 26 includes a developer housing 65 in which a toner dispensing cartridge 66 is rotatably mounted so as to dispense toner particles downward into a sump area occupied by the auger mixing and delivery assembly 70 of the present invention. Assembly 70 includes rotatably mounted augers 72 and 74.

Continuing with the description of operation at each developing station 24, a magnetic brush transport member 80 is disposed in predetermined operative relation to the photoconductive surface 14 of photoreceptor 12, the length of transport member 80 being equal to or slightly greater than the width of photoconductive surface 14, with the functional axis of transport member 80 parallel to the photoconductive surface and oriented at a right angle with respect to the path of photoreceptor 12. Advancement of transport member 80 carries the developer blanket 82 into the development zone in proximal relation with the photoconductive surface 14 of photoreceptor 12 to develop the latent electrostatic image therein.

A suitable controller is provided for operating the various components of machine 8 in predetermined relation with one another to produce full color images.

Figure 7:
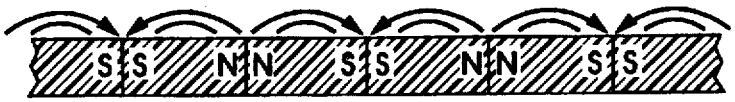
FIGS. 7–11 are alternative embodiments of the magnetic transport member incorporated in the magnetic brush assemblies shown in FIGS. 1–6.
Figure 11:
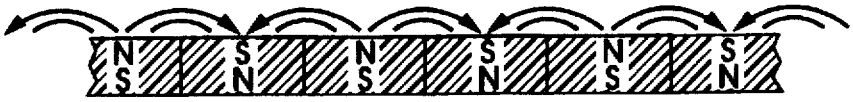
Figure 8:
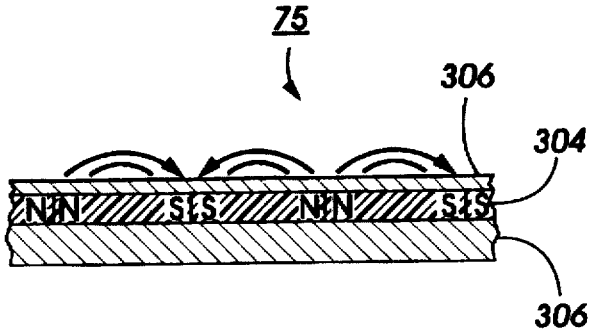
Figure 9:
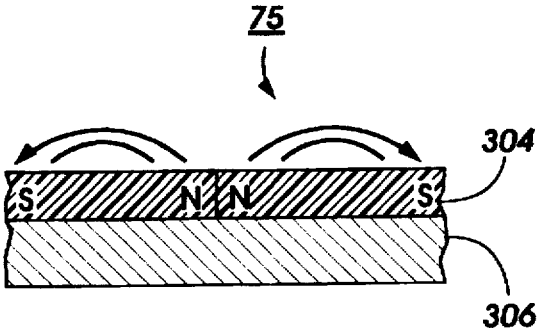
Figure 10:
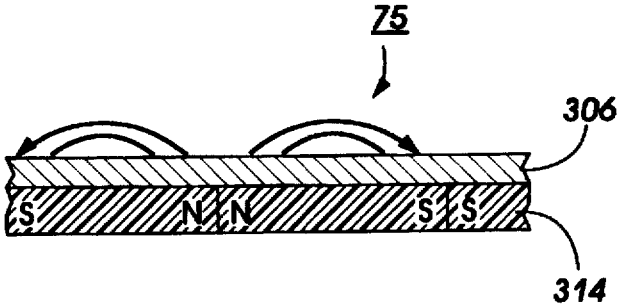

Further details of the construction and operation of magnetic brush transport member 80 of the present invention is provided below referring to FIGS. 2–5. In the present invention transport member 80 is fabricated with a surface of magnetically hard material that has been magnetized in a short spatial wavelength pattern chosen to saturate at the desired thickness of developer blanket 82. Preferably, the transport member is composed of a layer between 20 microns and 2 mm in thickness containing up to 80% by volume of neodymium iron boron or samarium cobalt compounds, or ceramic barium or strontium ferrite powder with a mean particle size of between 1 and 50 microns evenly dispersed in a stable binder. For use in the embodiments shown in FIG. 2 and FIGS. 4–5, the magnetic layer can be fabricated in the form of a self-supporting tube with a rigid binder as shown in FIG. 7, or applied in the form of a coating or layer on either the inner or outer surface of a rigid tubular substrate as illustrated in FIGS. 8–10. The magnetic layer may be fabricated with isotropic or aligned magnetic materials and magnetized in one of numerous spatial patterns, such as evenly spaced parallel lines, uniform checkerboards, a herringbone pattern, or "diffused-error" patterns of random dots, with the magnetization vector in each case alternatively oriented normally or parallel to the surface contacting the toner blanket. One configuration of special interest is a regular pattern of lines generally parallel to the axis of the transport member except for their ends which are curved or otherwise configured to minimize excessive accumulation of developer material at the edges of the blanket. It will be understood that selected portions of the magnetic layer may also be left unmagnetized in order to achieve specific design goals such as improving the life of optional dirt seals. Since the developer medium is in direct contact with the magnetic transport member surface, the spatial magnetization wavelength can be very short, holding a developer blanket 82 thickness on the order of ¼ to ½ the spatial wavelength. The lower limit is expected to be on the order of 3 or 4 times the developer bead size. The preferred blanket thickness is between 0.1 and 1 mm.

Figure 2:
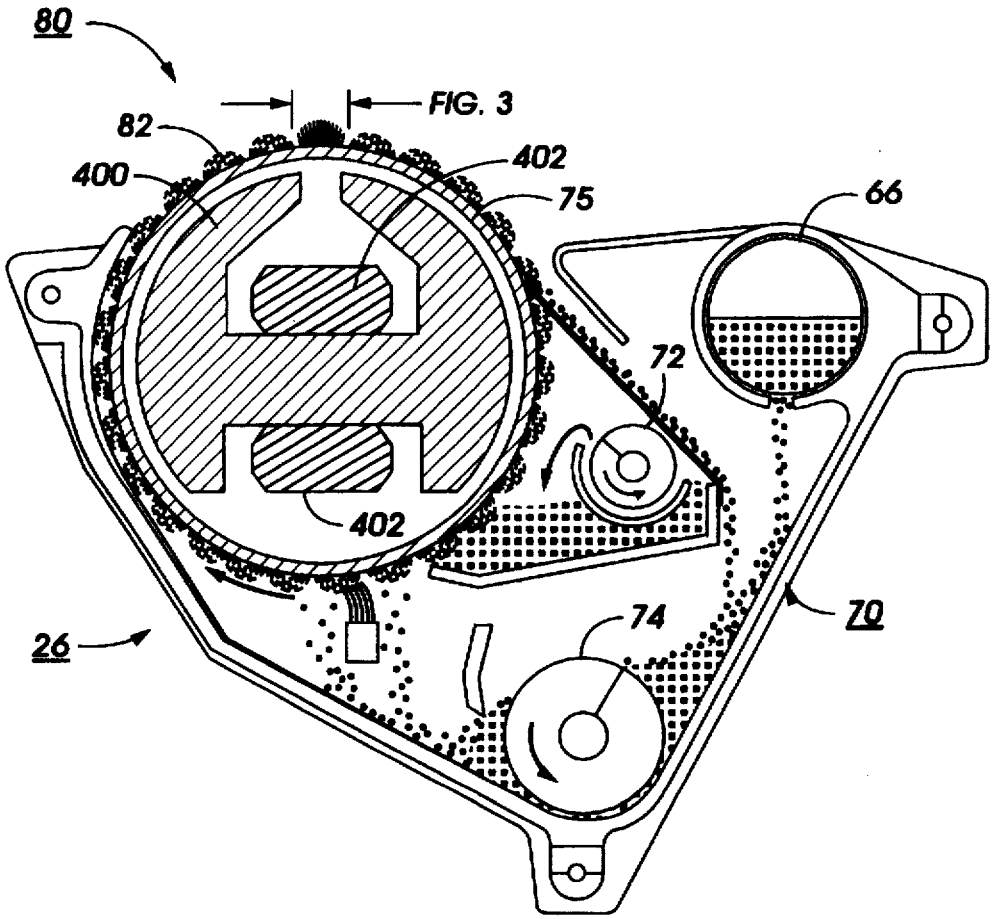
FIG. 2 is an enlarged side view of the developer assembly shown in FIG. 1 in a rotating tubular sleeve configuration.
Figure 5:
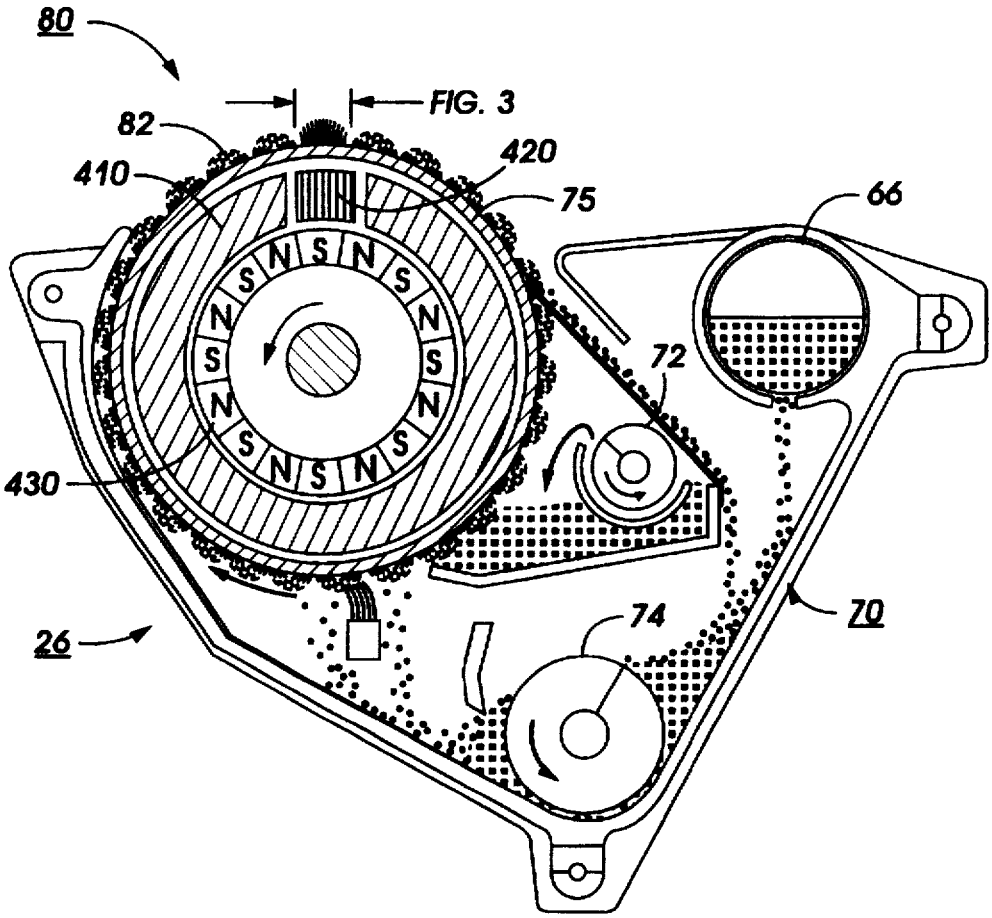
FIG. 5 is a second alternative embodiment of the alternating magnetic agitation means of the present invention.

Magnetized transport member 75 with an adhering blanket of developer is rotated through the development zone 112 where agitation is applied in the form of alternating fields from a rotating magnetic multipole (as shown in FIG. 5) or generated electromagnetically from structures within the transport member as shown in FIG. 2, or located behind the photoreceptor surface (not shown).

In essence, the filaments of the developer blanket 82 respond to the vector sum of the static fields provided by the magnetization pattern of the transport member, and the applied AC agitation fields, with the brush filaments dynamically aligning in the direction of the local net magnetic field lines which can be made to gyrate through large angles. It has been found that when the external perturbing field is provided by an AC electromagnet, the brush filaments gyrate through orbits at a rate determined by the applied electromagnet drive frequency.

It can be appreciated that since the blanket holding field and the agitation field are derived independently, the arrangement of the present invention provides a degree of engineering design freedom not available in previous art configurations. High resolution development in which image details in the range of 40 microns are accurately produced has been found to require a narrow effective development gap on the order of 200 microns. The absence of physical interactions requires that the magnetic filament lengths and therefore the spatial wavelength be as short as possible consistent with a developer blanket mass that can deliver an adequate supply of toner. It is well known that dipole and higher multipole magnetic fields fall off rapidly with distance from the magnetic source. The present invention places the developer material in direct contact with the source in the form of a magnetic pattern on the surface of the transport member. Thus the distance is minimum and the forces holding the developer blanket are stronger than for any other configuration with the same spatial wavelength and source strength. Since agitation is provided by a separate AC field source, formulation of the magnetic component of the transport member can be tailored as needed for optimum blanket characteristics. The thickness and magnetic loading of the transport member can both be chosen independently over a range of values, from containing a low percentage of magnetic material to comprising approximately 65% by volume, and the entrained magnetic component in the transport member can be chosen from several candidate materials.

The magnetic material of the transport member must be magnetically hard enough to remain permanently magnetized in the alternating applied field. This means that the magnetic material chosen should have a high coercivity (resistance to demagnetization). However, to maximize agitation, the applied fields should cause major local perturbations in the field directions at the transport member surface implying that the fields due to the magnetic pattern of the member itself be made as weak as is consistent with a well-behaved developer blanket. Since the intrinsic coercivity and magnetic remanance or "strength" of a given magnetic material are in a fixed relationship, one way of tailoring effective magnetic strength without reducing coercivity is to dilute the magnetically active component in a passive matrix to make a composite material 304 (i.e. magnetic layer which consists of barium ferrite #5 bonded in natsyn® by a matrix process known as plastiform® or a ceramic powder in epoxy) which can be cast or coated on a supporting substrate 306 (See FIG. 8). If the composite product is insulating, a thin relaxation layer in the form of a conductive coating 308 could be applied over the magnetic composite material 304, as shown in FIG. 8, to serve as a development electrode defining the electrostatic fields in the development zone. Alternatively, FIG. 9, a conductive pigment may be added to the composite formulation to provide bulk conductivity allowing development current to flow through the magnetic composite material 304 to the substrate 306 or to a separate collection electrode (not shown). Another alternative shown in FIG. 10 is to form the magnetic layer 314 on the reverse side of a thin substrate 312 that provides a durable conducting surface.

Figure 3:
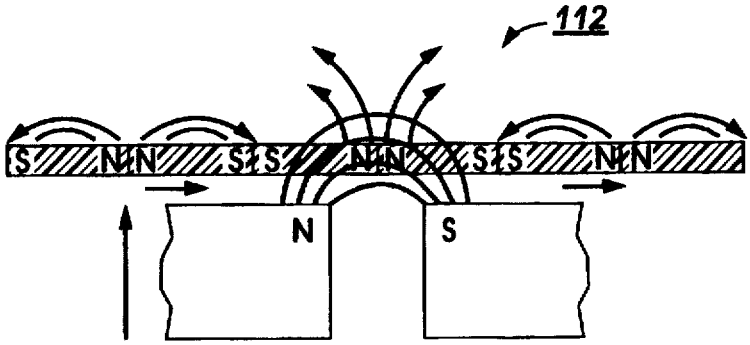
FIG. 3 is an enlarged view of the development area of the developer assembly shown in FIG. 2.
Figure 4:
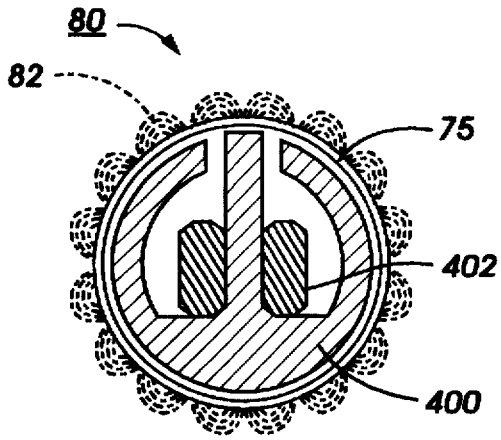
FIG. 4 is an alternative embodiment of the alternating magnetic agitation means present invention.

FIG. 2 shows one embodiment of the present invention, in which the transport member is in the form of a rigid tube or sleeve patterned with alternating, tangentially-oriented magnetic domains. The agitating field is confined to a narrow development zone 112 and is shown in FIG. 3 oriented parallel to the sleeve surface (one of several possible configurations). By confining the agitation field to a restricted region, toner clouding activity is limited to the development zone 112 which helps minimize toner escape that can cause dirt related problems throughout the machine. Since the fields holding the developer blanket outside the development zone 112 are static during transport, there are no interactions prior to development to promote uncontrolled bead chain growth and agglomeration which causes a wide statistical spread in bead chain lengths. As a result, the blanket entering development zone 112 will be relatively uniform, i.e., the mass and length of the magnetic chains will be determined by the regular spacing of the poles on the surface of the sleeve and fall within a narrower statistical envelope than if the blanket were continuously agitated during transport. The brush height is known to scale with the magnetic pattern wavelength which can be made quite small in the configurations of the present invention, and minimization of the statistical brush noise allows the system to operate with a relatively small development gap in the range of 150 to 350 microns for fine line reproduction and sharp edge response.

In operation the rotating magnetically patterned sleeve 75 with closely spaced poles holds a thin well-defined blanket of magnetic developer on the sleeve surface as shown in FIG. 2. The sleeve transports the blanket to the development zone 112 where an alternating field from electromagnetic coil 402 perturbs the local field directions at the surface of the sleeve causing the brush elements in the zone to gyrate at the electromagnet drive frequency. The collective vibrational action dislodges toner particles from the carrier surfaces making them available for transport to the photoreceptor image by the development fields. FIG. 5 shows an alternative method for generating the agitation fields in the development zone 112 that uses a rotating magnetic multipole core within a magnetic shield. The magnetic shield comprises a stationary high permeability cylindrical section 410 having a field conduit portion 420 around which magnetically patterned sleeve 75 rotates. A magnet assembly 430 rotates within section 410. In operation the rotating magnetically patterned sleeve 75 with short wavelength poles holds a thin blanket of magnetic developer to the sleeve. The sleeve transports the blanket to the development zone 112 over conduit portion 420 where alternating fields from magnet assembly 430 perturb the local field directions causing the brush elements to gyrate at a harmonic of the rotation frequency of magnet assembly 430. The collective vibrational interactions dislodge toner particles from the carrier surfaces making them available for transport to the photoreceptor image by the development fields.

Figure 6:
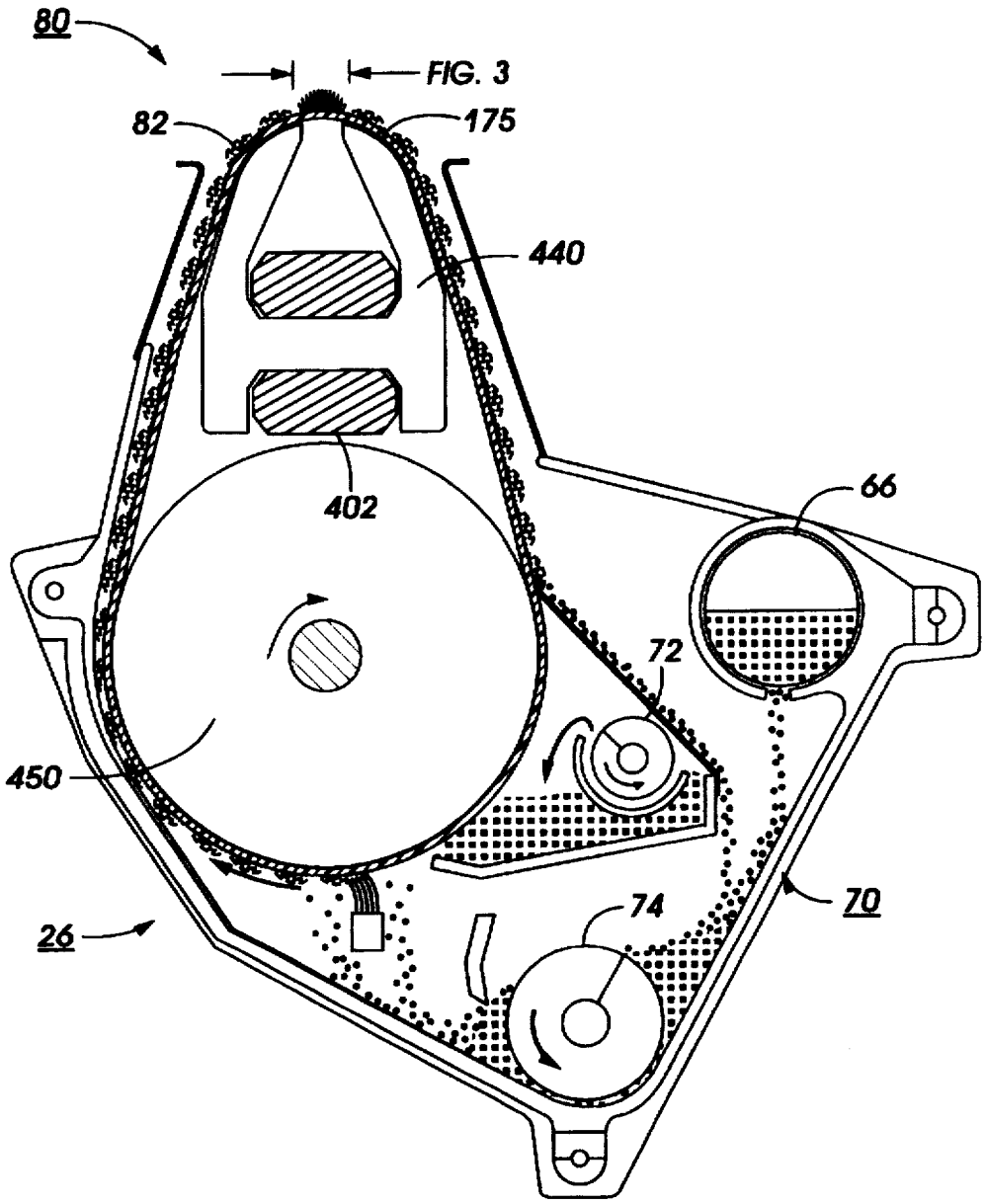
FIG. 6 is an enlarged side view of the developer assembly shown in FIG. 1 in a rotating flexible belt configuration.

FIG. 6 illustrates another embodiment of the present invention in which the transport member is a flexible belt having a magnetic surface with a static magnetic field pattern for transporting developer material to a development zone. As in the previous examples employing magnetically patterned rigid sleeves, the flexible belt 175 of the present invention is magnetized with closely spaced poles that hold a thin well-defined blanket of developer on the belt surface. The belt transports the blanket to the development zone 112 where an alternating field from electromagnetic support shoe 440 energized by coil 402 perturbs the local field directions at the surface of the belt causing the brush elements in the development zone to gyrate at the electromagnet drive frequency. The collective vibrational agitation dislodges toner particles from the carrier surfaces making them available for transport to the photoreceptor image by the development fields.

One important advantage in employing a flexible transport member or belt is that the development zone spacing, i.e., the gap between the magnetically patterned surface carrying the toner blanket and the photoreceptor surface in the development zone can be more precisely controlled for very wide imaging systems than is possible with a thin self supporting tube. In the case of the rotating tube, manufacturing tolerances of the tube body and end bearing assemblies, and asymmetric magnetic forces contribute to irreducible mechanical runout causing unwanted periodic variations in the development zone gap that increase with unsupported tube length. By contrast, a more substantial stationary belt guide or shoe can be fabricated of solid material and machined to the same radius in the region of the development zone within very close tolerances thereby producing a robust, very precisely located transport member surface. When the photoreceptor is a flexible belt supported by a similarly rigid guide shoe, there are no rotating components to contribute runout errors. Variations in the development gap are therefore reduced to variations in the thickness of the flexible belts, which can be fabricated to close tolerances, and fluctuations in the thickness of the developer blanket.

Referring again to FIG. 6, developer belt 175 passes over stationary guide shoe 440 comprising the pole pieces of an electromagnet energized by means of coil 402. Belt 175 may be in the form of a flexible substrate like elastomeric materials that supports a magnetically active coating, or may be wholly fabricated of a flexible magnetic composite such as flexible resins materials with magnetic material therein As indicated for the embodiments of the present invention discussed earlier, if the magnetic surface is insulating, a conductive coating 308 can be applied over the magnetic composite material 304 as shown in FIG. 8, or a conductive pigment may be added to the magnetic composite formulation as in FIG. 9 to provide bulk conductivity allowing development currents to flow to a collection point in order that the surface potential be well defined in the development zone.

The belt is propelled in an endless loop through the developer sump and over the guide shoe by means of rotatable drum 450 driven by a motorized linkage (not shown). In the preferred embodiment the development housing is designed so that the belt edges form seals with the inner drive cavity in order to minimize the accumulation of developer material behind the belt. It has been found that a belt fabricated from a composite containing magnetic material throughout its thickness can nevertheless be magnetized in a pattern having the desired developer blanket holding properties for transport on the outer surface without having similar holding forces on the inner surface. This simplifies the design and allows the employment of strategically placed cleaning grooves or channels to collect and eject developer from the drive cavity as the belt rotates. If desired, the drive cavity can also be maintained under modest air pressure to minimize dirt entry. The belt can be constrained passively by simple edge limiting guides or kept centered by a dynamic steering mechanism like that described in U.S. Pat. No. 5,246,099 to Genovese which is hereby incorporated by reference.

While the invention has been described with reference to the structures disclosed, it is not confined to the specific details set forth, but is intended to cover such modifications or changes as may come within the scope of the following claims:

What is claimed is:

1. In a development system including a member for depositing developer material on an imaging surface having an electrostatic latent image thereon, said development system comprising:

an endless web having a static magnetic field for transporting developer material to a development zone;

means for generating an alternating magnetic field to agitate developer material in said development zone; and a belt assembly for moving said endless web in a predetermined direction.

2. The development system of claim 1, further comprising means for generating an alternating magnetic field to agitate developer material in said development zone.

3. The development system of claim 1, wherein said endless web includes a flexible substrate having a magnetically active coating thereon.

4. The development system of claim 1, wherein said static magnetic field comprises a geometric pattern of short spatial wavelength.

5. The development system of claim 1, wherein said static magnetic field comprises a periodic pattern.

6. The development system of claim 5, wherein said periodic pattern comprises parallel lines.

7. The development system of claim 5, wherein said periodic pattern comprises curved lines.

8. In a development system including a member for depositing developer material on an imaging surface having an electrostatic latent image thereon, said development system comprising:

an endless web having a static magnetic field for transporting developer material to a development zone, means for generating an alternating magnetic field to agitate developer material in said development zone;

said endless web includes a flexible resin material with magnetic material therein; and a belt assembly for moving said endless web in a predetermined direction.

* * * * *